US011148774B2

(12) United States Patent
Axelsson et al.

(10) Patent No.: US 11,148,774 B2
(45) Date of Patent: Oct. 19, 2021

(54) REBALANCING OF UNDERWATER VEHICLES

(71) Applicant: SAAB AB, Linköping (SE)

(72) Inventors: Olle Axelsson, Linköping (SE); Nicklas Johansson, Vadstena (SE); Feras Faez Elias, Norrköping (SE)

(73) Assignee: SAAB AB, Linköping (SE)

( * ) Notice: Subject to any disclaimer, the term of this patent is extended or adjusted under 35 U.S.C. 154(b) by 214 days.

(21) Appl. No.: 16/471,988

(22) PCT Filed: Dec. 23, 2016

(86) PCT No.: PCT/SE2016/051318

§ 371 (c)(1),
(2) Date: Jun. 20, 2019

(87) PCT Pub. No.: WO2018/117925

PCT Pub. Date: Jun. 28, 2018

(65) Prior Publication Data

US 2020/0017180 A1 Jan. 16, 2020

(51) Int. Cl.

| | |
|---|---|
| ***B63G 8/16*** | (2006.01) |
| ***B63G 8/26*** | (2006.01) |
| ***B63G 8/00*** | (2006.01) |

(52) U.S. Cl.

CPC ..... *B63G 8/16* (2013.01); *B63G 8/26* (2013.01); *B63G 2008/004* (2013.01)

(58) Field of Classification Search

CPC ..... B63G 8/16; B63G 8/26; B63G 2008/004
See application file for complete search history.

(56) References Cited

U.S. PATENT DOCUMENTS 2,579,220 A 12/1951 Vine
7,506,606 B2 * 3/2009 Murphy ..... B63B 21/04 114/242

(Continued)

FOREIGN PATENT DOCUMENTS

CN 203581366 U 5/2014
EP 2301837 A1 3/2011

(Continued)

OTHER PUBLICATIONS

Extended European Search Report in corresponding European Patent Application No. 16924762.4 dated Jul. 13, 2020 (7 pages).

(Continued)

*Primary Examiner* — Russell Frejd
(74) *Attorney, Agent, or Firm* — Sage Patent Group

(57) ABSTRACT

A rebalancing device for rebalancing of an underwater vehicle comprises at least one thruster and at least one storage space. The rebalancing device comprises control circuitry. The control circuitry is configured to receive sensor data comprising information relating to a depth and an attitude of the underwater vehicle, and thruster data comprising information relating to thrust and orientation of thrust of the at least one thruster. The control circuitry is further configured to determine a difference between a centre of gravity, CoG, of the underwater vehicle and a centre of buoyancy, CoB, of the underwater vehicle based on the sensor data and the thruster data, and to determine a difference between a gravitational force acting on the underwater vehicle and a buoyancy of the underwater vehicle based on the sensor data and the thruster data.

16 Claims, 3 Drawing Sheets

(56) References Cited

U.S. PATENT DOCUMENTS

| | | | | |
|---|---|---|---|---|
| 9,315,248 | B2 * | 4/2016 | Williams | B63G 8/08 |
| 2016/0023733 | A1 | 1/2016 | Hawkes | |
| 2016/0325809 | A1 * | 11/2016 | Williams | B63B 3/13 |

FOREIGN PATENT DOCUMENTS

| | | | |
|---|---|---|---|
| EP | 2301838 | A1 | 3/2011 |
| JP | 2016064798 | A | 4/2016 |
| WO | 0192649 | A1 | 12/2001 |
| WO | 2012074408 | A2 | 6/2012 |
| WO | 2012074408 | A3 | 6/2012 |

OTHER PUBLICATIONS

International Search Report and Written Opinion in corresponding international application No. PCT/SE2016/051318 dated Sep. 15, 2017 (9 pages).

* cited by examiner

REBALANCING OF UNDERWATER VEHICLES

CROSS-REFERENCE TO RELATED APPLICATIONS

This application is a U.S. National Stage application of PCT/SE2016/051318, filed Dec. 23, 2016 and published on Jun. 28, 2018 as WO/2018/117925, all of which is hereby incorporated by reference in its entirety.

TECHNICAL FIELD

The present disclosure relates to rebalancing of underwater vehicles.

BACKGROUND

The weight distribution of an underwater vehicle has a considerable impact on the manoeuvrability and energy efficiency of the propulsion of the underwater vehicle. In order to be considered to have a good weight distribution, the buoyancy of the underwater vehicle should be approximately equal to the weight of the underwater vehicle, and the weight should be distributed such that the underwater vehicle is relatively stable. The latter may be summarized such that the ideal weight distribution is to have the centre of buoyancy to be equal to the centre of gravity.

In order to be able to better adjust the weight distribution, many underwater vehicles are equipped with designated spaces where weight may be added or removed, or buoyancy-increasing means may be introduced. The process of changing a current weight distribution to get closer to an ideal weight distribution is called rebalancing. To date, the approach to finding a good weight distribution is to manually test different weight distribution configurations or by studying the thrust of the thrusters of the underwater vehicle as the underwater vehicle hovers in the water. This is cumbersome and time consuming, and is particularly problematic for underwater vehicles, e.g. when the underwater vehicle is moved from freshwater to saltwater or if additional equipment is arranged on or removed from the underwater vehicle.

Hence, there is a need in the art for improved rebalancing of underwater vehicles.

Furthermore, an underwater vehicle which makes a change in its weight distribution during operational use, e.g. by picking up or dropping of an object, will inevitably change the relationship between the centre of buoyancy of the underwater vehicle and the centre of gravity of the underwater vehicle. Since it may not be possible to change the weight distribution during operational use of the underwater vehicle, the change in weight distribution and/or buoyancy may adversely affect the power efficiency of the propulsion of the underwater vehicle. It may also be that at some stage during a mission, either at the start or after picking up a load, the underwater vehicle becomes too heavy and won't float, i.e. its weight is greater than its buoyancy. If there is an accident or a power failure there is a risk that the underwater vehicle is lost because it will sink.

Hence, there is a need in the art for systems and methods for determining the impact of a weight distribution state of an underwater vehicle on the operational efficiency of the underwater vehicle.

SUMMARY

It is an object of the present disclosure to provide devices, vehicles, methods and computer programs for rebalancing and load impact determination.

The disclosure relates to a rebalancing device for rebalancing of an underwater vehicle comprising at least one thruster and at least one storage space. The rebalancing device comprises control circuitry. The control circuitry is configured to receive sensor data comprising information relating to a depth and an attitude of the underwater vehicle. The control circuitry is further configured to receive thruster data comprising information relating to thrust and orientation of thrust of the at least one thruster. The control circuitry is also configured to determine a difference between a centre of gravity, CoG, of the underwater vehicle and a centre of buoyancy, CoB, of the underwater vehicle based on the sensor data and the thruster data. The control circuitry is additionally configured to determine a difference between a gravitational force acting on the underwater vehicle and a buoyancy of the underwater vehicle based on the sensor data and the thruster data. The control circuitry is yet further configured to generate rebalancing information relating to a deviation of a current load distribution from an ideal load distribution based on the determined differences. The rebalancing device provides information, in the form of the rebalancing information, relating to a load balance of the underwater vehicle in an automatic manner. The rebalancing information enables determining performance metrics, such as power consumption or the ability to complete a mission, or how to best rebalance the underwater vehicle.

According to some aspects, the control circuitry is further configured to determine the difference between the CoG and the CoB based on the amount of thrust and orientation of thrust needed by the at least one thruster to maintain a predetermined attitude of the underwater vehicle. According to some aspects, the control circuitry is further configured to determine difference between a gravitational force acting on the underwater vehicle and a buoyancy of the underwater vehicle based on the amount of thrust and orientation of thrust needed by the at least one thruster to maintain a predetermined depth of the underwater vehicle. This provides computationally fast and cost-effective estimates for the desired differences. It reduces the need for complex models and precise knowledge of all significant masses, e.g. added equipment, since the effects of these will appear implicitly in the amount of thrust and orientation of thrust needed by the thrusters to maintain the desired depth and attitude.

According to some aspects, the control circuitry is further configured to determine a preferred load for each of the at least one storage space based on the determined difference between the CoG and the CoB, the preferred loads reducing or eliminating the determined difference between the CoG and the CoB and reducing or eliminating the determined difference between the gravitational force acting on the underwater vehicle and the buoyancy of the underwater vehicle. The rebalancing device provides semi-automatic rebalancing, i.e. it overcomes the need for trial and error to arrive at a well-balanced underwater vehicle. The automatic rebalancing is potentially more precise than trial and error, thereby further optimizing performance metrics such as power consumption. The time it takes to perform rebalancing is reduced considerably compared to the prior art.

According to some aspects, the rebalancing device is configured to have an active mode and a passive mode, wherein, in the active mode, the rebalancing device is further configured to assume control of the underwater vehicle and further configured to identify necessary changes for rebalancing by regulating and manoeuvring the underwater vehicle, and wherein, in the passive mode, the rebalancing device is additionally configured to perform real-time monitoring of the balance of the underwater vehicle during operational use of the underwater vehicle. According to some further aspects, the rebalancing device is configured to transmit a warning to an operator of the underwater vehicle based on the monitoring in the passive mode indicating a need for rebalancing. The active mode provides assistance for preparing operational use of the underwater vehicle. The active mode provides a completely automated solution to determining how to rebalance the underwater vehicle; operator skill and input needed for rebalancing is reduced or eliminated. The passive mode provides assistance during operational use of the underwater vehicle. In particular, the operator may be warned if there is a need for rebalancing, e.g. when the underwater vehicle is at risk due to poor load balance or being unable to complete a mission.

According to some aspects, the rebalancing device comprises at least one sensor arranged to obtain at least one of the sensor data comprising information relating to a depth of the underwater vehicle and the sensor data comprising information relating to an attitude of the underwater vehicle. According to some aspects, the rebalancing device comprises at least one sensor arranged to obtain at least one of the thruster data comprising information relating to thrust of the at least one thruster and the thruster data comprising information relating to orientation of thrust of the at least one thruster. Dedicated sensors ensure the availability of the necessary sensor data and reduce the need to rely on data from the underwater vehicle to obtain the desired information. Dedicated sensors ensure a desired minimum precision of the sensor data.

The present disclosure also relates to underwater vehicles comprising at least one thruster, at least one storage space and a rebalancing device according to the present disclosure. The present disclosure further relates to methods comprising method steps configured to carry out the steps of the rebalancing device according to the present disclosure.

The present disclosure yet further relates to computer programs configured to carry out the methods disclosed herein. The disclosed underwater vehicles, methods and computer programs each exhibit the same technical effects and associated advantages as the disclosed rebalancing device.

DETAILED DESCRIPTION

Figure 1:
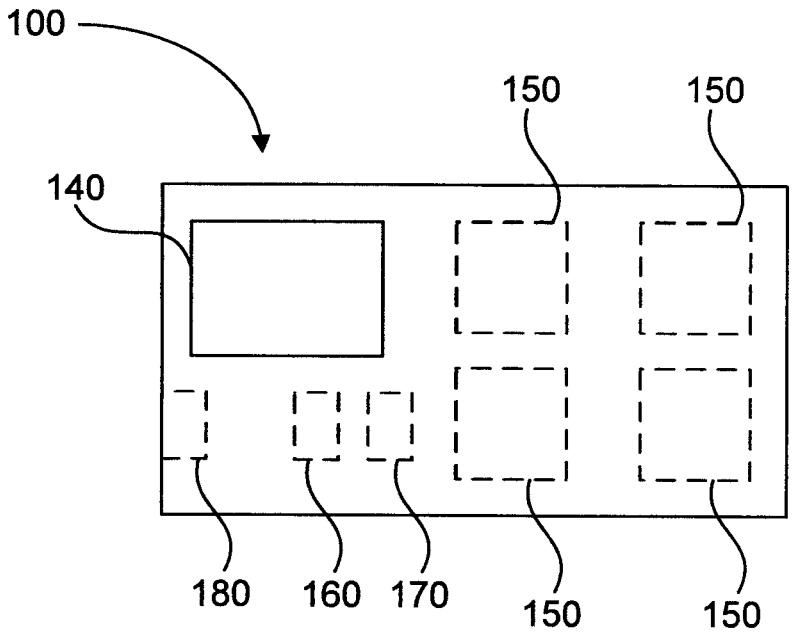
FIG. 1 is a block diagram illustrating examples of a rebalancing device according to the present disclosure.

FIG. 1 is a block diagram illustrating embodiments of a rebalancing device 100 according to the present disclosure. The rebalancing device 100 is suitable for rebalancing of an underwater vehicle comprising at least one thruster and at least one storage space.

By thruster we mean a device configured to generate a reaction force by expelling or accelerating mass in a direction opposite of the reaction force. A common form of thruster for underwater vehicles is a propeller, which accelerates water mass in a first direction and hence causes a reaction force to act on the thruster in the direction opposite to the first direction. Other examples of thrusters would be different types of underwater jet engines.

The rebalancing device 100 comprises control circuitry 140. The control circuitry 140 is configured to receive sensor data comprising information relating to a depth and an attitude of the underwater vehicle. Attitude is a collective term for roll, pitch and yaw, which are rotations about principal axes of the underwater vehicle.

According to some aspects, the control circuitry 140 is arranged at the underwater vehicle. According to some other aspects, the control circuitry 140 is arranged separate, at least in part, from the underwater vehicle, and further arranged to be communicatively connected to the underwater vehicle. The communicative connection may be arranged by means of a fibre-optic cable or a copper cable. Optionally, if the underwater vehicle is configured to be operated in an autonomous mode, either by itself or controlled by the rebalancing device 100, the communicative connection may be arranged by at least one of an acoustic modem, an optical modem, a radio interface, a wireless local area network, WLAN, or any underwater communication capable of transmitting the necessary information between the underwater vehicle and the rebalancing device 100.

The information relating to a depth and an attitude of the underwater vehicle is configured to enable determining a current depth and attitude of the underwater vehicle. The information relating to a depth may be determined directly, e.g. from sensor data obtained from e.g., a hydrostatic sensor, such as bubblers, displacers, differential pressure sensors or absolute pressure sensors. The information relating to a depth may also be determined indirectly, e.g. from sensor data obtained from e.g., ultrasonic, radar or laser technology, and knowledge of bathymetry under the underwater vehicle. Alternatively, a distance to a surface under the underwater vehicle, i.e. the sea floor, may be determined. The distance to the surface under the underwater vehicle may be determined by an altimeter. According to some aspects, a Doppler velocity log is used to determine the distance to the surface under the underwater vehicle. Since a distance to the bottom of the sea floor will correlate with a depth, being configured to maintain a constant depth and obtain and process sensor data relating to the depth is to be understood as including the possibility of being arranged to maintain a constant distance to the bottom of the sea floor and obtain and process sensor data relating to the distance to the bottom of the sea floor. The information relating to an attitude may be obtained by, e.g. a gyroscope or one or more accelerometers in combination with continuous dead reckoning calculations. According to some aspects, the rebalancing device 100 comprises at least one sensor 150 arranged to obtain at least one of the sensor data comprising information relating to a depth of the underwater vehicle and the sensor data comprising information relating to an attitude of the underwater vehicle.

The control circuitry 140 is also configured to receive thruster data comprising information relating to thrust and orientation of thrust of the at least one thruster. The thruster data is configured to enable determining the magnitude and direction of a reaction force for each of the at least one thruster. In case the thruster comprises a motor-driven propeller, the revolutions per minute, RPM, of the motor, and hence the propeller, will correlate with the amount of water being expelled in one direction, and thus the magnitude of a corresponding reaction force in the opposite direction. The orientation of thrust may be obtained with respect to a local coordinate system, e.g., by measuring the orientation of a thruster with respect to the underwater vehicle, or with respect to a global coordinate system, e.g. by a gyroscope arranged at the thruster. In case the orientation of a thruster is fixed, its orientation may be derived from design specifications, e.g. computer-aided design drawings. According to some aspects, the rebalancing device comprises at least one sensor arranged to obtain at least one of the thruster data comprising information relating to thrust of the at least one thruster and the thruster data comprising information relating to orientation of thrust of the at least one thruster.

In the absence of external forces, such as a water current, and thrust from any of the at least one thrusters, an improper weight distribution will cause a rotation of the underwater vehicle, i.e. a change in the attitude of the underwater vehicle. Therefore, the control circuitry 140 is further configured to determine a difference between a centre of gravity, CoG, of the underwater vehicle and a centre of buoyancy, CoB, of the underwater vehicle based on the sensor data and the thruster data.

In order for the underwater vehicle to remain at a constant depth, assuming no water current is acting on the underwater vehicle to affect its depth, the buoyancy of the underwater vehicle should match the gravitational force acting on the underwater vehicle. Therefore, the control circuitry 140 is additionally configured to determine a difference between a gravitational force, $F_g$, acting on the underwater vehicle and a buoyancy, $F_b$, of the underwater vehicle based on the sensor data and the thruster data.

The main idea of how to determine the difference between the centre of gravity and the centre of buoyancy, as well as the difference between $F_g$ and $F_b$, is to set up and solve torque and force equations of significant masses and forces of a system representing the current physical situation of the underwater vehicle. Significant masses means masses that are considered heavy enough to have a significant impact on the so-called balance of the underwater vehicle. Any weights or buoyancy means present in the at least one storage space constitute examples of such significant masses. Other significant masses may be the weight of the thrusters, the whole or parts of the hull the underwater vehicle and heavy equipment of, or arranged at, the underwater vehicle.

In particular, by using the thrusters to maintain the underwater vehicle at a constant depth and at a constant known attitude, it is possible to set up the force and torque equations by determining the thrust and direction of thrust of each thruster of the underwater vehicle, and knowing their spatial relationship. Unless the underwater vehicle is ideally balanced, i.e. having an ideal load distribution which enables the underwater vehicle to remain in equilibrium without the use of its thrusters, there will be a difference between $F_g$ and $F_b$, and the centre of gravity and the centre of buoyancy. The use of the thrusters to keep the underwater vehicle at a fixed position and attitude thus enables an easy way of estimating the differences without the need for complex models and detailed knowledge of the underwater vehicle.

The difference between the centre of gravity and the centre of buoyancy, as well as the difference between the gravitational force acting on the underwater vehicle and the buoyancy of the underwater vehicle relate to the current load of the underwater vehicle and how the load is distributed. If there were no differences present, the underwater vehicle is considered to have an ideal load distribution. In practice, this is rarely the case and the deviation of the current load distribution from the ideal load distribution will have an impact on the performance of the underwater vehicle. For instance, the underwater vehicle will require more thrust during operational use to compensate for the deviation, which in turn may reduce the maximum amount of time the underwater vehicle is able to operate during a mission. If the load distribution deviates too much from the ideal load distribution, it may even put the underwater vehicle at risk. It is therefore of interest for an operator to use the determined differences to monitor the impact of the differences on the performance of the underwater vehicle and, if possible, reduce the negative impact by rebalancing the underwater vehicle.

Thus, the control circuitry 140 is further configured to generate rebalancing information relating to a deviation of a current load distribution from an ideal load distribution based on the determined differences.

The rebalancing information may be in the form of steps to perform rebalancing of the underwater vehicle. Many underwater vehicles comprise storage spaces where weight may be added or removed. According to some aspects, the rebalancing information comprises information enabling an operator to change the current loads of the storage spaces to reduce or eliminate the determined differences. The information is preferably presented as a series of steps configured to rebalance the underwater vehicle.

According to some aspects, the rebalancing information comprises information relating to the impact the deviation has on the performance of the underwater vehicle. The rebalancing information then enables real-time monitoring of the underwater vehicle and the option of generating warnings to an operator during operational use of the underwater vehicle, which will be explained further below. The information relating to the impact of the deviation may also comprise status information. According to some aspects, the status information comprises information arranged to provide the operator with information that the underwater vehicle is stuck. For instance, the underwater vehicle may be caught in a net or a rope, which is then reported to the operator as part of the status information. According to some aspects, the status information comprises thruster status. A thruster which is lost or broken is not able to contribute to determine the difference between the CoG and the CoB, and the difference between $F_g$ and $F_b$. It will furthermore not be able to offset any determined differences and will thus affect the performance of the underwater vehicle. With the thruster status, the rebalancing device is able to take into account a wider set of parameters which influence performance. The thruster status also enables the rebalancing device to take the thruster status into account and, if other thrusters are available to compensate, to compensate for the loss of the thruster, thereby improving robustness of a system in which the rebalancing device is arranged. According to some further aspects, the thruster status comprises information relating to loss of or damage to a propeller of a thruster. Loss or damage will affect the correlation between amount of thrust and the actual amount of water being displaced. Thus, knowing that a propeller is not working properly or is missing enables the rebalancing device to compensate for this when determining the differences between CoG and CoB, as well as $F_g$ and $F_b$.

The difference between $F_g$ and $F_b$ may be determined by determining the total amount of thrust needed in a direction parallel to a direction of either $F_g$ or $F_b$ to keep the underwater vehicle at a constant depth. Therefore, according to some aspects, the control circuitry 140 is further configured to determine difference between a gravitational force acting on the underwater vehicle and a buoyancy of the underwater vehicle based on the amount of thrust and orientation of thrust needed by the at least one thruster to maintain a predetermined depth of the underwater vehicle.

By keeping the underwater vehicle at a constant attitude and determining the thrust and direction of thrust of each thruster of the underwater vehicle, the thrust and direction of thrust of each thruster combined with the known spatial relationship of each thruster enables determining how much torque is needed to offset the difference between the centre of gravity and the buoyance centre in order to keep the attitude constant, i.e. it enables determining the difference between the centre of gravity and the centre of buoyancy.

Thus, according to some aspects, the control circuitry 140 is further configured to determine the difference between the centre of gravity and the centre of buoyancy based on the amount of thrust and orientation of thrust needed by the at least one thruster to maintain a predetermined attitude of the underwater vehicle.

Effects of water current may be taken into consideration by providing the underwater vehicle with a sensor configured to determine a speed and direction of the water current, e.g. one or more flow meters. According to some aspects, the water current is determined by so-called drifters, which follow the current and provides information about its position at different times, thereby enabling determination of the speed and direction of the water current. According to some aspects, the underwater vehicle is configured to receive information enabling determination of the water current. The information may be forecasts and/or observations received from an external source, e.g. via a radio or a telecommunication cable interface. Alternatively, the underwater vehicle may comprise a memory configured to store water current forecasts, which may be used by the underwater vehicle when determining the difference between $F_g$ and $F_b$ and the difference between the centre of gravity and the buoyance centre.

With the difference between $F_g$ and $F_b$ and the difference between the centre of gravity and the buoyance centre determined, and knowing the spatial relationship between the at least one storage space as well as the current respective loads of the at least one storage space, it is possible to determine how a change in the respective loads would reduce or eliminate the determined differences between $F_g$ and $F_b$ and the centre of gravity and the centre of buoyancy. By adding or subtracting a mass making up for the difference between $F_g$ and $F_b$, while at the same time distributing the added or subtracted mass in the at least one storage space, the difference between the centre of gravity and the buoyance centre may be counteracted. In practice it may not be possible to completely eliminate both the difference between $F_g$ and $F_b$ and the difference between the centre of gravity and the centre of buoyancy, so a compromise, i.e. a reduction of the differences, has to be made. According to some aspects, such a compromise is based on the rebalancing which would reduce the power consumption during operational use of the underwater vehicle the most.

Therefore, according to some aspects, the control circuitry is further configured to determine a preferred load for each of the at least one storage space based on the determined difference between the centre of gravity and the centre of buoyancy, the preferred loads reducing or eliminating the determined difference between the centre of gravity and the centre of buoyancy and reducing or eliminating the determined difference between the gravitational force acting on the underwater vehicle and the buoyancy of the underwater vehicle.

The rebalancing device 100 preferably comprises a processor 160 configured to execute a computer program, wherein the computer program comprises computer program code which, when executed, causes the control circuitry to determine the difference between the centre of gravity, CoG, of the underwater vehicle and the centre of buoyancy, CoB, of the underwater vehicle based on the sensor data and the thruster data, and to determine the difference between the gravitational force acting on the underwater vehicle and the buoyancy of the underwater vehicle based on the sensor data and the thruster data. The rebalancing device 100 preferably also comprises a non-volatile memory 170 configured to store the computer program. The non-volatile memory 170 may also comprise water current forecasts.

The rebalancing device 100 optionally comprises a communications interface 180. The communications interface 180 is preferably configured to receive control signals and/or information relating to water current, wherein the control signals are configured to control the rebalancing device 100 via the control circuitry 140. The rebalancing device 100 may also be configured to provide any of control signals, sensor data and model data via the communications interface 180. For instance, control signals to the underwater vehicle may be provided via the communications interface 180.

According to some further aspects, the control circuitry 140 is configured to be arranged, at least in part, separate from the underwater vehicle. For instance, the processor 160 and/or memory 170 of the control circuitry 140 may be separate from the underwater vehicle. According to some aspects, the processor 160 and memory 170 is comprised in a computer, wherein the computer, and hence the processor 160 and memory 170, is in communication with the underwater vehicle. According to some aspects, the communications interface 180 is configured to provide a communications link between the computer and the underwater vehicle. According to some further aspects, sensor data is transmitted to the computer via the communications interface. The processor 160 and memory 170 is configured to determine the difference between CoG and CoB, and the difference between $F_g$ and $F_b$ based on the sensor data. The processor and memory is also configured to transmit control signals to the underwater vehicle via the communications interface 180 based on the determined differences. The communications interface 180 may comprise a tether or umbilical cord configured to enable communication between the computer and the underwater vehicle. The computational resources of the rebalancing device 100 may thereby be placed above the water, e.g. on land or a mother ship. By separating the computational resources of the rebalancing device 100 from any parts needed to be arranged on or at the underwater vehicle, the computational resources are protected from any problems that may occur with the underwater vehicle. Furthermore, the computational resources will not be limited to the power available to the underwater vehicle. This enables the use of more computationally powerful processors and greater memory.

Sensor data and model data may be provided to an external user, e.g. an operator above water communicating with the rebalancing device 100 via a communications cable. The external user may use the sensor data to generate model data, or receive model data from the rebalancing device, and use the sensor and/or model data to generate control signals which are then transmitted to the rebalancing device 100 via the communications cable. According to some aspects, the rebalancing device is configured to communicate with a human-machine interface configured to present the rebalancing information. Optionally, the rebalancing device 100 comprises a human-machine interface configured to present the rebalancing information. According to some further aspects, the computer comprising the processor 160 and the memory 170 is further configured to function as the human-machine interface. According to some aspects, the rebalancing device 100 is configured to output the determined preferred load for each of the at least one storage space to the human-machine interface. The preferred loads may be presented as a series of steps needed to be performed in order to rebalance the underwater vehicle. The rebalancing device may be configured to output a measure of how well-balanced the underwater vehicle is to the human-machine interface. The measure of how well-balanced the underwater vehicle is may be presented as a total percentage of an ideal load balance. According to some aspects, the rebalancing device is configured to output an estimate of how much longer the underwater vehicle may travel and/or operate if rebalancing is performed based on the determined preferred loads. Optionally, the rebalancing device is configured to output, for each thruster, an estimate of the difference between a current thrust and a thrust needed if the underwater vehicle was ideally balanced. According to some aspects, the memory is configured to store the sensor and thruster data during operational use of the underwater vehicle. According to some further aspects, the rebalancing device is configured to perform post-processing of the stored sensor and thruster data, wherein the post-processing comprises generating any of the above-mentioned outputs to the human-machine interface.

According to some aspects, the control circuitry 140 is further arranged to transmit control signals to the underwater vehicle, the control signals being arranged to control the thrust and direction of thrust of the at least one thrusters of the underwater vehicle during the determination of the difference between the centre of gravity, CoG, of the underwater vehicle and the centre of buoyancy, CoB, of the underwater vehicle based on the sensor data and the thruster data, and the difference between the gravitational force acting on the underwater vehicle and the buoyancy of the underwater vehicle based on the sensor data and the thruster data.

According to some aspects, the rebalancing device 100 is configured to have an active mode and a passive mode. In the active mode, the rebalancing device 100 is further configured to assume control of the underwater vehicle and further configured to identify necessary changes for rebalancing by regulating and manoeuvring the underwater vehicle. In other words, in the active mode, the rebalancing device 100 assumes control of the underwater vehicle and by certain control and manoeuvring measures identifies necessary adjustments of the balancing of the underwater vehicle. Thus, the rebalancing and optionally the obtaining of sensor data are performed automatically. In the passive mode, the rebalancing device 100 is additionally configured to perform real-time monitoring of the balance of the underwater vehicle during operational use of the underwater vehicle. According to some further aspects, the rebalancing device 100 is configured to transmit a warning to an operator of the underwater vehicle based on the monitoring in the passive mode indicating a need for rebalancing. Data associated with the real-time monitoring, such as sensor and thruster data, and the deviation of the current load distribution from an ideal load distribution, are preferably comprised in the rebalancing information. The warning transmitted to the operator may also be comprised in the rebalancing information.

Figure 2:
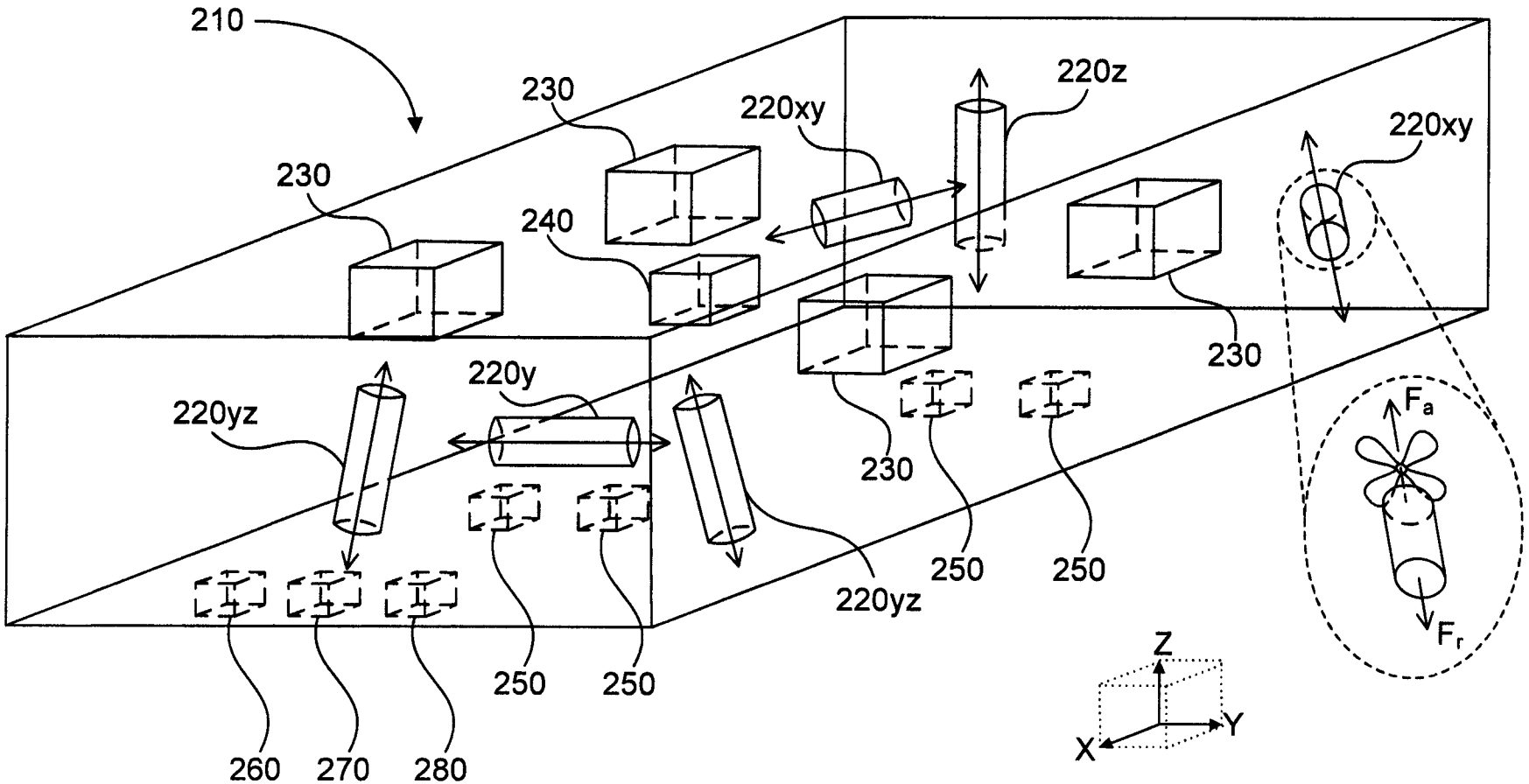
FIG. 2 is a perspective view illustrating examples of an underwater vehicle according to the present disclosure.

FIG. 2 is a perspective view illustrating embodiments of an underwater vehicle 210 according to the present disclosure. While an underwater vehicle 210 having high symmetry with respect to shape and load distribution may do with one or two thrusters, for most underwater vehicles the minimum number of thrusters needed is three, in order to be able to compensate for any three-dimensional force. According to some aspects, each thruster comprises a motor driven propeller configured to displace water to generate an effective force $F_a$, thereby causing a reactive force $F_r$ acting on the respective thruster, as illustrated in the inset of FIG. 2. The underwater vehicle 210 disclosed in FIG. 2 comprises six thrusters, each thruster being able to generate thrust in a span of predetermined directions with respect to a local coordinate system XYZ; two fixed thrusters 220*y*, 220*z* able to generate thrust in the y- and z-direction, respectively, and two pairs of thrusters 220*xy*, 220*yz* symmetrically placed about respective planes though the centre of the underwater vehicle, each thruster 220*xy*, 220*yz* in the pairs of thrusters being able to generate thrust in the xy- and yz-planes, respectively. Each thruster 220*xy*, 220*y*, 220*yz*, 220*z* has a predetermined weight and position on the underwater vehicle 210. Each thruster 220*xy*, 220*yz* in the pairs of thrusters is configured to be able to generate thrust in a predetermined span of directions within the xy- and yz-planes, respectively. According to some aspects, each thruster 220*xy*, 220*yz* in the pairs of thrusters is configured to be able to move irrespective of the direction of the other thruster in the pair. With this configuration of thrusters, the underwater vehicle 210 is able to travel in any direction under water while keeping a constant attitude.

The underwater vehicle further comprises at least one storage space 230. For illustrative purposes, the underwater vehicle 210 in FIG. 2 comprises four storage spaces 230. The storage spaces 230 have a predetermined spatial relationship, i.e. their positions are known in advance. By knowing their positions in advance, it is possible to determine how their respective loads affect the centre of gravity, i.e. how their respective loads influence how well-balanced the underwater vehicle 210 is. The storage spaces are preferably arranged symmetrically about one or more planes. In the examples of FIG. 2, the storage spaces are arranged symmetrically about the xz- and yz-planes. The symmetrical arrangement enables a change in load distribution to affect only the net weight of the underwater vehicle without any contribution to net torque with respect to an axis of a symmetry plane or vice versa, i.e. contribute with a net torque with respect to an axis of a symmetry plane without affecting the net weight of the underwater vehicle. By adding or subtracting an equal amount of weight on respective sides of a symmetry plane, net torque with respect to a line in the symmetry plane is unaffected, but the net weight of the underwater vehicle has changed. By adding a load in a storage space on one side of a symmetry plane, while simultaneously removing an equal amount from a storage space on an opposite side, a change in net torque is generated, without affecting the total weight of the underwater vehicle. In order to effectively set up torque equations for the loads in the storage spaces, it is preferable if the storage spaces have as limited extension as possible. The more limited extension of a storage space is, the better approximation a point mass representing the load will be. In other words, storage spaces having a predetermined size being much smaller than the overall size of the underwater vehicle 210 facilitates effective determination of how well-balanced the underwater vehicle 210 is given a certain load distribution. Storage spaces having one or more dimensions comparable to a leading spatial dimension of the underwater vehicle 210 may be considered as a set of smaller storage spaces joined together, thereby enabling effective representations of complex load distributions.

Knowledge of the respective positions and weights of the thrusters 220$xy$, 220$y$, 220$yz$, 220$z$ enables setting up torque equations for each thruster and solve the set of equations for the entire underwater vehicle 210. The solution to the set of equations will provide estimations to how the centre of gravity, CoG, of the underwater vehicle differs from the centre of buoyancy, CoB, of the underwater vehicle 210, and how the gravitational force, $F_g$, acting on the underwater vehicle 210 differs from the buoyancy, $F_b$, of the underwater vehicle 210.

The obtained estimates for the differences between the centre of gravity and the centre of buoyancy, and between the $F_g$ and $F_b$ may then be used to provide information of consequences relating to the estimated differences, such as increased fuel and/or power consumption, and provide a basis for how to rebalance the underwater vehicle 210 to reduce or eliminate the differences.

If the current loads of the respective storage spaces 230 are known, it is possible to use the obtained estimates for the differences between the centre of gravity and the centre of buoyancy, and between the $F_g$ and $F_b$ to set up equilibrium equations for determining how to change the current loads of the respective storage spaces such that the determined differences between the centre of gravity and the centre of buoyancy, and between the $F_g$ and $F_b$ can be compensated in order to rebalance the underwater vehicle 210.

The underwater vehicle configured to provide the above mentioned analysis as follows. At least one sensor 250 is arranged at the underwater vehicle. One or more of the sensors 250 may be comprised in the underwater vehicle 210. Optionally the sensors are external to the underwater vehicle 210. The sensors 250 are configured to obtain sensor data, the sensor data comprising information relating to a depth and an attitude of the underwater vehicle 210, and thruster data comprising information relating to thrust and orientation of thrust of the thrusters 220$xy$, 220$y$, 220$yz$, 220$z$.

The underwater vehicle 210 further comprises a rebalancing device for rebalancing of the underwater vehicle 210. The rebalancing device comprises control circuitry 240 configured to receive the sensor data. The sensors 250 are configured to provide the control circuitry 240 with the sensor data. The control circuitry 240 is further configured to determine a difference between a gravitational force, $F_g$, acting on the underwater vehicle 210 and a buoyancy, $F_b$, of the underwater vehicle 210 based on the sensor data and the thruster data. The control circuitry 240 is also configured to determine a difference between a centre of gravity, CoG, of the underwater vehicle and a centre of buoyancy, CoB, of the underwater vehicle based on the sensor data and the thruster data.

With the rebalancing device, the underwater vehicle 210 is configured to receive the sensor data and use it to determine how the current load distribution differs from an ideal load distribution. The underwater vehicle 210 preferably comprises a processor 260 configured to execute a computer program, wherein the computer program comprises computer program code which, when executed, causes the control circuitry 240 to determine the difference between the centre of gravity, CoG, of the underwater vehicle 210 and the centre of buoyancy, CoB, of the underwater vehicle 210 based on the sensor data and the thruster data, and to determine the difference between the gravitational force acting on the underwater vehicle and the buoyancy of the underwater vehicle based on the sensor data and the thruster data. The underwater vehicle 210 preferably also comprises a non-volatile memory 270 configured to store the computer program. The processor 260 and memory 270 may be comprised in the rebalancing device. Optionally, the processor 260 and memory 270 are arranged externally to the body of the underwater vehicle. For instance, the processor 260 and memory 270 may be arranged in a computer, which is separate from the body of the underwater vehicle, as described above in relation to FIG. 1. The underwater vehicle is then configured to transmit the sensor and thruster data to the computer. The processor and memory are configured to receive the sensor and thruster data and generate rebalancing information, and control signals, as described above and below. Spatial relationship information enabling determination of spatial relationships of the thrusters 220$xy$, 220$y$, 220$yz$, 220$z$ and storage spaces 230 may be comprised in the memory 270. Optionally, the spatial relationship information is comprised in the computer program. Load distribution information enabling determination of the respective weight of the thrusters 220$xy$, 220$y$, 220$yz$, 220$z$ and/or a current load of the respective storage spaces 230 may also be comprised in the memory 270. Optionally, the load distribution information is comprised in the computer program.

According to some aspects, the underwater vehicle comprises a communications interface 280. The communications interface 280 is configured to receive one or more of control signals, spatial relationship information, load distribution information and sensor data. According to some further aspects, the communications interface 280 is configured to transmit information relating to the determined differences between $F_g$ and $F_b$ and the centre of gravity and the centre of buoyancy. The transmitted information may comprise information of how to change the loads of the storage spaces 230 to obtain a load distribution closer to an optimal load distribution. In other words, the transmitted information may comprise information enabling rebalancing of the underwater vehicle. The information of how to change the loads is preferably configured to be presented as a series of steps for rebalancing, wherein each step is configured to successively bring the underwater vehicle 210 closer to an ideal load balance. According to some aspects, the steps are presented as suggested changes of the current loads of the respective storage spaces 230.

The transmitted information may comprise performance metrics based on the determined differences. For instance, a required power output relationship between the determined differences and the required power output of the thrusters to maintain a constant depth and/or attitude may be determined prior to operational use of the underwater vehicle 210. The required power output relationship may be transmitted, e.g. as a percentage of required power output at optimal load balance or a maximum remaining mission time based on estimated power consumption and available power.

A warning signal may be transmitted to an operator based on the determined differences. For instance, the underwater vehicle 210 may be so poorly balanced, e.g. from picking up or dropping of a load, that the load distribution puts the underwater vehicle 210 at risk. The warning signal may also be based on the required power output relationship, e.g. to indicate that the underwater vehicle 210 will run out of power before being able to complete a mission.

According to some aspects, the underwater vehicle 210 is configured to operate in two modes; an active mode and a passive mode. In the active mode, the rebalancing device is configured to assume control over the manoeuvring of the underwater vehicle 210 and by means of adjustments and manoeuvring identify necessary changes of the load balance of the underwater vehicle 210. The passive mode is configured to be used as a real-time surveillance of the load balance of the underwater vehicle 210 during operational use. An operator may then be provided with a warning signal during operational use, as has been described above.

Figure 3:
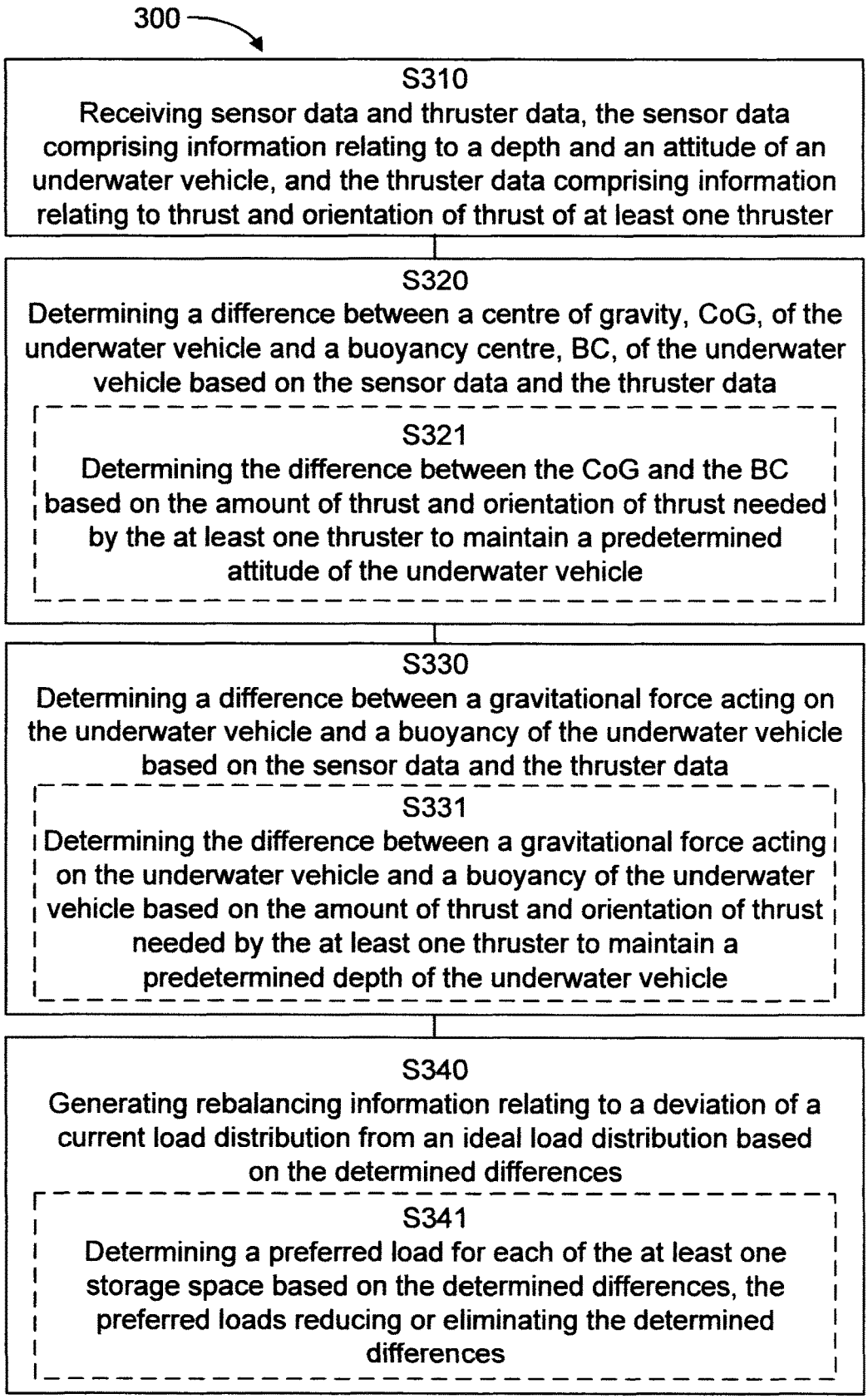
FIG. 3 is a flowchart illustrating examples of a method for rebalancing an underwater vehicle according to the present disclosure.

FIG. 3 is a flowchart illustrating embodiments of a method 300 for rebalancing of an underwater vehicle comprising at least one thruster and at least one storage space.

In practice, the underwater vehicle will typically first be placed in water and subsequently be manoeuvred to a place suitable for performing rebalancing. Once in place, i.e. at the desired depth and attitude, sensor data is obtained.

The method comprises receiving S310 sensor data and thruster data. The sensor data comprises information relating to a depth and an attitude of the underwater vehicle, and the thruster data comprises information relating to thrust and orientation of thrust of the at least one thruster.

With the sensor and thruster data received, and knowing a spatial relationship between the thrusters, it is possible to set up and solve torque and force equations of a system representing the current physical situation of the underwater vehicle.

Thus, the method 300 further comprises determining S320 a difference between a centre of gravity, CoG, of the underwater vehicle and a centre of buoyancy, CoB, of the underwater vehicle based on the sensor data and the thruster data. The method 300 also comprises determining S330 a difference between a gravitational force acting on the underwater vehicle and a buoyancy of the underwater vehicle based on the sensor data and the thruster data.

As has been described above, the thrust and direction of thrust needed by the thrusters to keep a constant depth and attitude of the underwater vehicle may be used to estimate the difference between the centre of gravity and the centre of buoyancy, as well as the difference between the gravitational force acting on the underwater vehicle and the buoyancy of the underwater vehicle.

Thus, according to some aspects, determining S320 a difference between a centre of gravity, CoG, of the underwater vehicle and a centre of buoyancy, CoB, of the underwater vehicle further comprises determining S321 the difference between the centre of gravity and the centre of buoyancy based on the amount of thrust and orientation of thrust needed by the at least one thruster to maintain a predetermined attitude of the underwater vehicle.

Likewise, according to some aspects, determining S330 the difference between the gravitational force acting on the underwater vehicle and the buoyancy of the underwater vehicle based on the sensor data and the thruster data further comprises determining S331 the difference between the gravitational force acting on the underwater vehicle and the buoyancy of the underwater vehicle based on the amount of thrust and orientation of thrust needed by the at least one thruster to maintain a predetermined depth, or optionally a predetermined altitude, of the underwater vehicle.

The determined differences may be used to generate rebalancing information for decision support. For instance, since a deviation between the current load distribution and an ideal load distribution affects the power consumption of the underwater vehicle, it is possible to generate estimates on how much power consumption is needed for the current load distribution and how much power consumption is needed if the underwater vehicle was ideally balanced. Such a difference may adversely affect the duration possible for operational use of the underwater vehicle and may make a mission impossible to carry out unless the underwater vehicle is rebalanced. The rebalancing information may thus enable an operator to determine if it is necessary to rebalance the underwater vehicle. The rebalancing information may comprise information of how rebalancing is optimally performed. For instance, the rebalancing information may provide details of how the current loads in storage spaces of the underwater vehicle should be changed in order to rebalance the underwater vehicle, as will be described further below. Thus, the method further comprises generating S340 rebalancing information relating to a deviation of a current load distribution from an ideal load distribution based on the determined differences.

With the differences between the centre of gravity and the centre of buoyancy, as well as the differences between the gravitational force and the buoyancy determined, it is possible to use the determined differences as a basis for how to best rebalance the underwater vehicle. In other words, according to some aspects, the generating rebalancing information S340 further comprises determining S341 a preferred load for each of the at least one storage space based on the determined difference between the centre of gravity and the centre of buoyancy, the preferred loads reducing or eliminating the determined difference between the centre of gravity and the centre of buoyancy and configuring the gravitational force acting on the underwater vehicle to match the buoyancy of the underwater vehicle. This also significantly reduces the amount of time needed to perform rebalancing compared to using trial and error or manually finding an optimal load distribution based on the determined differences. Underwater vehicles can thus be rebalanced quickly, thereby reducing total mission times while simultaneously improving the power consumption efficiency of the underwater vehicle.

In a preferred embodiment, the step of determining how to rebalance the underwater vehicle, i.e. determining S341 the preferred loads, is performed automatically. The automatic rebalancing may be performed in an active mode, wherein the rebalancing device of the underwater vehicle assumes control of the underwater vehicle during the determination of the preferred loads and keeps the underwater vehicle at a desired point, maintaining a constant depth and constant attitude. Upon completion of determining the preferred loads, the results are preferably presented to an operator in such a way that it is clear which actions are necessary to rebalance the underwater vehicle. In other words, according to some aspects, the method comprises illustrating information relating to the determined differences, the information being configured to enable an operator to rebalance the underwater vehicle based on the illustrated information. With the information of how to rebalance the underwater vehicle, the underwater vehicle is preferably removed from the water and weights are added or removed from the at least one storage space in accordance with the information of how to rebalance the underwater vehicle. The underwater may then be replaced in the water. According to some further aspects, the method comprises performing real-time monitoring of the balance of the underwater vehicle during operational use of the underwater vehicle.

The present disclosure also relates to computer programs comprising computer program code which, when executed in a processor communicatively connected to a rebalancing device as described above and below, causes the rebalancing device to carry out the disclosed method as described above and below.

The invention claimed is:

1. Rebalancing device for rebalancing of an underwater vehicle comprising at least one thruster and at least one storage space, the rebalancing device comprising control circuitry, the control circuitry being configured to receive sensor data, the sensor data comprising information relating to a depth and an attitude of the underwater vehicle, and thruster data comprising information relating to thrust and orientation of thrust of the at least one thruster, wherein the control circuitry being further configured to determine a difference between a centre of gravity, CoG, of the underwater vehicle and a centre of buoyancy, CoB, of the underwater vehicle based on the sensor data and the thruster data, determine a difference between a gravitational force acting on the underwater vehicle and a buoyancy of the underwater vehicle based on the sensor data and the thruster data, and generate rebalancing information relating to a deviation of a current load distribution from an ideal load distribution based on the determined differences.

2. The rebalancing device according to claim 1, wherein the control circuitry is further configured to determine the difference between the centre of gravity and the centre of buoyancy based on the amount of thrust and orientation of thrust needed by the at least one thruster to maintain a predetermined attitude of the underwater vehicle.

3. The rebalancing device according to claim 1, wherein the control circuitry is further configured to determine the difference between the gravitational force acting on the underwater vehicle and a buoyancy of the underwater vehicle based on the amount of thrust and orientation of thrust needed by the at least one thruster to maintain a predetermined depth of the underwater vehicle.

4. The rebalancing device according to claim 1, wherein the control circuitry is further configured to determine a preferred load for each of the at least one storage space based on the determined difference between the centre of gravity and the centre of buoyancy, the preferred loads reducing or eliminating the determined difference between the centre of gravity and the centre of buoyancy and reducing or eliminating the determined difference between the gravitational force acting on the underwater vehicle and the buoyancy of the underwater vehicle.

5. The rebalancing device according to claim 1, wherein the rebalancing device is configured to have an active mode and a passive mode, wherein, in the active mode, the rebalancing device is further configured to assume control of the underwater vehicle and further configured to identify necessary changes for rebalancing by regulating and maneuvering the underwater vehicle, and wherein, in the passive mode, the rebalancing device is additionally configured to perform real-time monitoring of the balance of the underwater vehicle during operational use of the underwater vehicle.

6. The rebalancing device according to claim 5, wherein the rebalancing device is configured to transmit a warning to an operator of the underwater vehicle based on the monitoring in the passive mode indicating a need for rebalancing.

7. The rebalancing device according to claim 1, wherein the rebalancing device comprises at least one sensor arranged to obtain at least one of the sensor data comprising information relating to a depth of the underwater vehicle and the sensor data comprising information relating to an attitude of the underwater vehicle.

8. The rebalancing device according to claim 1, wherein the rebalancing device comprises at least one sensor arranged to obtain at least one of the thruster data comprising information relating to thrust of the at least one thruster and the thruster data comprising information relating to orientation of thrust of the at least one thruster.

9. An underwater vehicle comprising at least one thruster and at least one storage space, wherein the underwater vehicle comprises a rebalancing device according to claim 1.

10. The underwater vehicle according to claim 9, wherein the underwater vehicle comprises at least one sensor arranged to obtain at least one of the sensor data comprising information relating to a depth of the underwater vehicle and the sensor data comprising information relating to an attitude of the underwater vehicle.

11. The underwater vehicle according to claim 9, wherein the underwater vehicle comprises at least one sensor arranged to obtain at least one of the thruster data comprising information relating to thrust of the at least one thruster and the thruster data comprising information relating to orientation of thrust of the at least one thruster.

12. A method for rebalancing of an underwater vehicle comprising at least one thruster and at least one storage space, the method comprising:

receiving sensor data, the sensor data comprising information relating to a depth and an attitude of the underwater vehicle, and thruster data comprising information relating to thrust and orientation of thrust of the at least one thruster;

determining a difference between a centre of gravity, CoG, of the underwater vehicle and a centre of buoyancy, CoB, of the underwater vehicle based on the sensor data and the thruster data;

determining a difference between a gravitational force acting on the underwater vehicle and a buoyancy of the underwater vehicle based on the sensor data and the thruster data; and generating rebalancing information relating to a deviation of a current load distribution from an ideal load distribution based on the determined differences.

13. The method according to claim 12, wherein determining a difference between a centre of gravity, CoG, of the underwater vehicle and a centre of buoyancy, CoB, of the underwater vehicle further comprises:

determining the difference between the centre of gravity and the centre of buoyancy based on the amount of thrust and orientation of thrust needed by the at least one thruster to maintain a predetermined attitude of the underwater vehicle.

14. The method according to claim 12, wherein determining the difference between the gravitational force acting on the underwater vehicle and the buoyancy of the underwater vehicle based on the sensor data and the thruster data further comprises:

determining the difference between the gravitational force acting on the underwater vehicle and the buoyancy of the underwater vehicle based on the amount of thrust and orientation of thrust needed by the at least one thruster to maintain a predetermined depth of the underwater vehicle.

15. The method according to claim 12, wherein generating rebalancing information further comprises:

determining a preferred load for each of the at least one storage space based on the determined difference between the centre of gravity and the CoB, and the determined difference between the gravitational force acting on the underwater vehicle and the buoyancy of the underwater vehicle, the preferred loads reducing or eliminating the determined difference between the centre of gravity and the centre of buoyancy and configuring the gravitational force acting on the underwater vehicle to match the buoyancy of the underwater vehicle.

16. A non-transitory computer storage medium storing computer-executable instructions which, when executed in a processor communicatively connected to a rebalancing device, causes the rebalancing device to carry out the method steps according to claim 12.

* * * * *